United States Patent [19]

Spitzer

[11] Patent Number: 4,967,736

[45] Date of Patent: Nov. 6, 1990

[54] EXERCISE MACHINE FOR DORSAL AND PLANTAR FLEXION

[76] Inventor: Mary M. Spitzer, 1202 Nobel Ave., S.W., Decatur, Ala. 35601

[21] Appl. No.: 368,275

[22] Filed: Jun. 19, 1989

Related U.S. Application Data

[63] Continuation-in-part of Ser. No. 7,180, Jan. 27, 1987, abandoned.

[51] Int. Cl.[5] ..... A61H 1/02

[52] U.S. Cl. ..... 128/25 B; 128/25 R

[58] Field of Search ..... 128/25 R, 25 B, 33, 128/44, 51, 52, 46; 272/96, 97, 144

[56] References Cited

U.S. PATENT DOCUMENTS

| | | | |
|---|---|---|---|
| 1,813,006 | 7/1931 | White et al. | 128/25 B |
| 2,186,105 | 1/1940 | Hall | 128/25 B |
| 2,202,187 | 5/1940 | Challette | 128/25 R |
| 2,235,158 | 3/1941 | Krenzke | 128/25 R |
| 3,071,130 | 1/1963 | Hoyer et al. | 128/33 X |
| 3,525,522 | 8/1970 | Piller | 272/96 |
| 3,581,739 | 6/1971 | Brandt | 272/144 X |
| 3,605,732 | 9/1971 | Rapoza | 128/25 B |
| 4,086,921 | 5/1978 | Gouzales et al. | 128/25 B |
| 4,151,839 | 5/1979 | Schwarz | 128/26 R X |
| 4,299,206 | 11/1981 | Hofstein | 272/96 |
| 4,548,289 | 10/1985 | Mechling | 128/25 R |
| 4,628,909 | 12/1986 | Tetsworth | 128/25 B X |
| 4,705,028 | 11/1987 | Melby | 128/25 B |
| 4,858,599 | 8/1989 | Halpern | 128/33 |
| 4,862,875 | 9/1989 | Heaton | 128/25 B |

*Primary Examiner*—Richard J. Apley
*Assistant Examiner*—H. N. Flaxman
*Attorney, Agent, or Firm*—George J. Porter

[57] ABSTRACT

A device for exercising various extremities of the body is disclosed. The device is particularly useful for exercising one's feet, ankles and leg muscles, while the user is in the sitting position. The exercise device consists of a stationary base (12) and a movable platform (14) which is pivotally connected to the base for pivoting and oscillating motion with respect thereto. The platform (14) is suspended above the base (12) so that the platform is freely capable of both pivotal and oscillatory movement without touching the top edges or vertical sides of the base and yet, the platform cooperates with the base to completely enclose the machine. A motor (40) supplies power to drive the platform through a worm reduction unit (42) and by a series of driving elements (46, 48, 68, 69, 70, 72, 80, 82 and 83) provides an oscillating movement to attachment block (30) which is attached beneath the rear portion of the platform (14) while the pivotal connection of the platform (14) to the base (12) is made between attachment blocks (26) and the platform (14). Thus it will be apparent that the platforms (14) is pivoted near its forward central portion and oscillated at its rearward portion whereby movement of an extremity along the platform (14) in a forward or rearward position will result in a greater or lessor pivotal and/or oscillation movement.

9 Claims, 5 Drawing Sheets

EXERCISE MACHINE FOR DORSAL AND PLANTAR FLEXION

CROSS REFERENCE TO RELATED APPLICATION

This application is a continuation-in-part of prior U.S. patent application Ser. 07/007,180, filed Jan. 27, 1987 abandoned Oct. 20, 1989, by Mary Motlow Spitzer and entitled "Exercise Machine for Dorsal and Plantar Flexion" and now pending.

TECHNICAL FIELD

The present invention relates to an exercise machine and more specifically to an exerciser or exercise machine for dorsal and plantar flexion of the feet, so as to exercise the feet, the ankles and the leg calf muscles.

BACKGROUND OF THE INVENTION

Exercise machines in general are well known in the prior art. These machines fall generally into two basic categories, this is, passive, wherein the energy for actuation of the machine is supplied by an outside source, and active, wherein the energy for operating the machine is supplied by the user. As will be disclosed in more detail below, the present invention falls into the former or passive categorY. Immediately below is a disclosure of several prior art patents known to the applicant and which collectively constitute examples of both the above-mentioned categories.

The closest prior art patent appears to be U.S. Pat. No. 3,605,732 to RAPOZA. Rapoza discloses a passive exercise machine which can exercise the feet and also the ankles and wrists, if special brackets are used with the machine. The machine has a flat, planar support surface which is pivotally supported by two vertical arms through the use of an axle attached to the planar surface and journaled in holes formed in the arms. The machine is driven by a motor connected to a crank arm which is connected to the rear edge of the planar surface by a turnbuckle mounted between two springs. Users of the machine must wear special shoes to which are attached base plates having stud-like members which must be inserted into any one of a number of apertures in the planar surface and be fastened to the planar surface with butterfly wing nuts.

The above-described device has several disadvantages. First, it takes considerable preparation to get ready to use the machine, since one has to put on special shoes having attached base plates and studs, the studs have to be inserted into apertures in the planar surface and wing nuts then have to be attached and tightened down on the underside of the planar surface. This is exceptionally awkward for the user to do and may well require the services of a second person to "hook up" the user to the machine. Secondly, the machine is completely open with the moving parts of the drive system exposed, which creates a potential safety hazard. Thirdly, the planar surface is biased to the normally level position by several springs and the oscillatory motion is imparted from the crank arm to the planar surface through two springs and a turnbuckle. Thus, the device has a "springy" or unstable feel to it, rather than a firm, solid and stable feel. Moreover, the springs, since they expand and contract with each movement of the planar surface, will suffer metal fatigue after a finite number of flexures, thus causing a requirement for frequent maintainance of the device. Fourthly, since the oscillatory motion is imparted to the planar surface through springs rather than through a solid link, the planar surface is caused to flop up and down each time the crank arm pauses over center, rather than to impart a smooth, rhythmic motion to the planar surface. Lastly, since the planar surface is designed to be normally level, it is not positioned at the right angle of elevation for comfortable exercising of the feet and ankles.

Another prior art device, shown in U.S. Pat. No. 3,071,130 to HOYER et al, is a leg exercising device. This device consists of an open frame attached to a couch and supporting a flat member which supports a patient's leg. The flat member is pivoted at the end where it is attached to the couch. Also, the flat member has a motor-driven system for tilting the leg-supporting member through a predetermined arc. This device also has the disadvantage that it is of open construction with its drive mechanism exposed, and thus it also represents a safety hazard. In addition, the arrangement of the device is well-suited for exercising a person's leg, if the person is lying down. However, it is not suitable for exercising a person's foot or ankle, in either the prone or sitting position.

Another prior art patent is U.S. Pat. No. 2,186,105 to HALL. The Hall device is not a machine for exercising the feet or ankles. Hall calls his device a "manipulator". Actually, it is a machine for massaging the bottoms of the feet in the areas of the arches and the front portion of the heels, by use of round or rectangular mechanical fingers, which protrude up through holes in his foot plate. Hall has a sloping top on his base but has no way of freely moving either the top of his device or his platform with respect to his base. His platform is only slightly moveable through the use of a concentric cam height adjustment.

Still another prior art patent is U.S. Pat. No. 3,525,522 to PILLER. This invention is an active, friction-type foot exercising device. The device has two foot pedal treads which are receded into a base and pivotally attached to the base at their centers. This comparatively simple device accomplishes its purpose as a foot or ankle exerciser but has little flexibilitY in what It can do. Also, it requires the active participation of the patient, since it is not a powered exerciser.

U.S. Pat. No. 2,235,158 to KRENZKE shows an invention which looks somewhat similar to the present invention. However, it is a vibrator, not a foot exerciser. Krenzke has a top platform with sides which overhang his base but he contemplated no free movement of his top with respect to his base, since his platform is securely fastened to his base with screws.

TIETSWORTH, in U.S. Pat. No. 4,628,909, shows a passive machine for exercising a patient's arms and legs, while the patient is in a supine position. However, no provision is seen for exercising the feet or ankles of a patient or exercising a patient's legs while in the sitting position.

Thus, it may be seen that none of the above-cited prior art patents known to the applicant provides a modern, passive exercise machine which can be used by a patient in the sitting position and which provides both safe operation and reliable, smooth, and stable operation over a long period of time.

Therefore, the object of this invention is to provide a modern, passive exercise machine which can be used comfortably by a patient in the sitting position to exercise the feet, ankles and leg muscles.

A further object of this invention is to provide an exerciser which can furnish gentle, stable, positive and rhythmic motion to the platform in order to exercise the feet, ankles and large leg muscles while the patient is in the sitting position Still another object of the invention is to provide a completely enclosed exerciser device which is safe for all patients, including those who are mentally ill, retarded, senile or have Alzheimer's disease.

Yet another object of this invention is to provide an exercise machine having a movable platform suspended above a stationary base in such a manner that the platform is freely capable of both pivotal and oscillatory movement without touching the top edges or vertical sides of the base and yet, the platform cooperates with the base to completely enclose the machine.

SUMMARY OF THE INVENTION

The present invention is an exercise machine for dorsal and plantar flexion of the feet, so as to exercise the feet, ankles, and calf leg muscles. The device provides gentle, stable and rhythmic motion to flex and relax the leg muscles and thus provide a sqeezing motion which aids the return of venous blood to the heart to prevent venous stasis. The same action promotes the flow of lYmph into the thoracic duct and the right lymphatic duct.

The exerciser comprises:

1. A base comprising (1) a horizontal bottom portion and (2) an upper portion comprising an upstanding front wall, an upstanding rear wall which is lower in height than said front wall and two upstanding side walls, each said side wall being attached to one edge of said front wall and one edge of said rear wall, each said side wall having a top edge which slopes downward from the top edge of said front wall to the top edge of said rear wall.

2. A rectangular platform for supporting a user's feet, said platform being pivotally supported above said base and tilted downwardly from a point above said front wall of said base to a point above said rear wall of said base, said platform comprising:

(1) a flat, rectangular top portion comprising both an outer surface and an inner surface; and (2) four walls attached to said top portion and extending downward from the four edges of said top portion, said four walls of said platform overlapping and covering the top edges of said four upstanding walls of said upper portion of said base, said four walls of said platform being spaced apart from said four upstanding walls of said base, said platform being capable of moving independently of said base without touching any portion of said base.

3. Pivotal means for supporting said platform above said base, said pivotal means being attached to the center portion of said inner surface of said top portion of said platform.

4. Oscillating means for supporting said platform above said base, said oscillating means being attached to the lower portion of said inner surface of said top portion of said platform, said oscillating means being capable of exerting both a pushing and a pulling motion on said top portion of said platform.

5. Electro-mechanical drive means attached to said oscillating means for imparting an oscillating movement to one portion of said platform and a pivotal movement to another portion of said platform.

6. Means for varying the distance between said pivotal means and said oscillating means, whereby the extent of oscillation of said platform may be increased or decreased by varying said distance between said pivotal means and said oscillating means.

The platform and the base together provide a complete enclosure for the exerciser. Selective placement of the user's feet on the forward or rear portion of said platform will result in a selective increase or decrease of both the oscillatory and pivotal motion imparted by the platform.

BRIEF DESCRIPTION OF THE DRAWINGS

FIG. 5 also shows a portion of the pivotal means, namely, one of the two bearing blocks, in phantom.

DETAILED DESCRIPTION OF THE INVENTION

Figure 1:
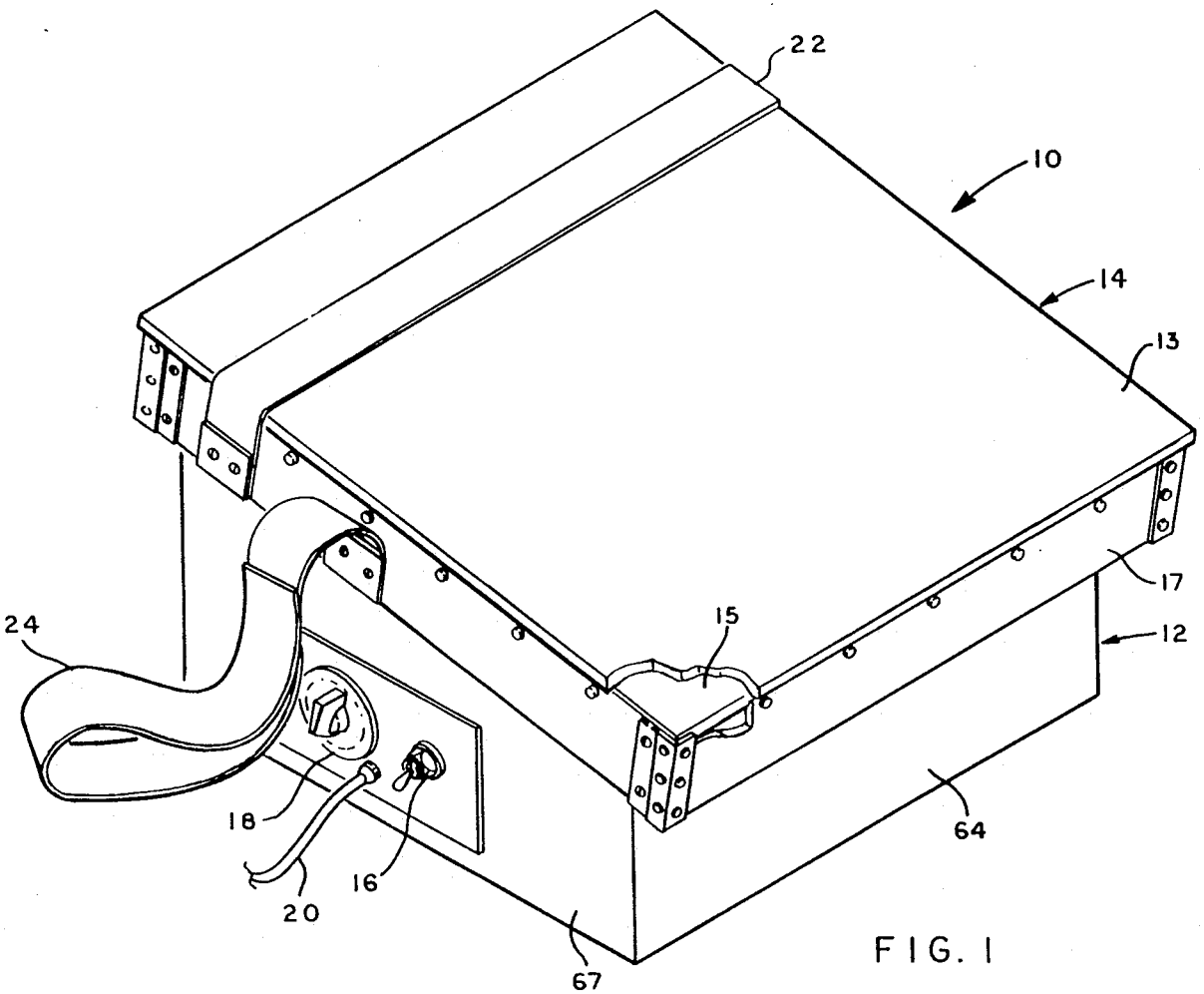
FIG. 1 is a perspective view of the exercising device with portions broken away for clarity of its construction.
Figure 3:
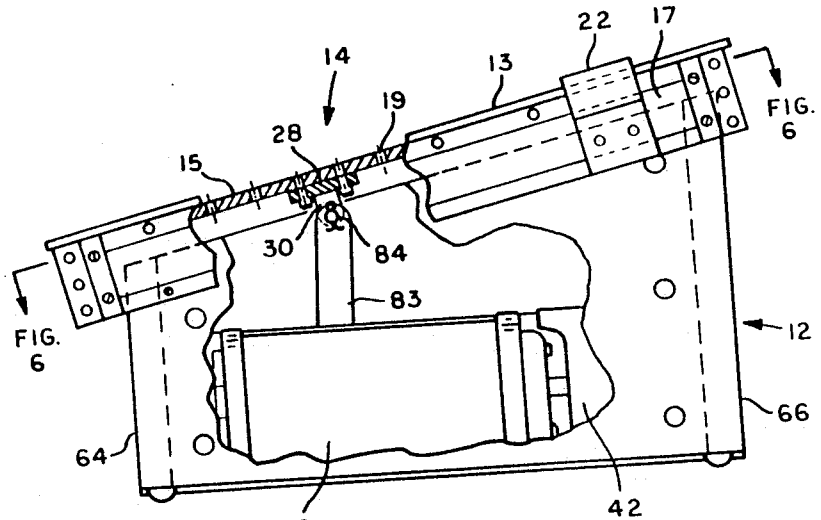
FIG. 3 is a side elevational view of the device illustrating its general tilting relationship with respect to the surface on which it rests as well as the adjustment of the oscillatory motion of the platform of the device.
Figure 2:
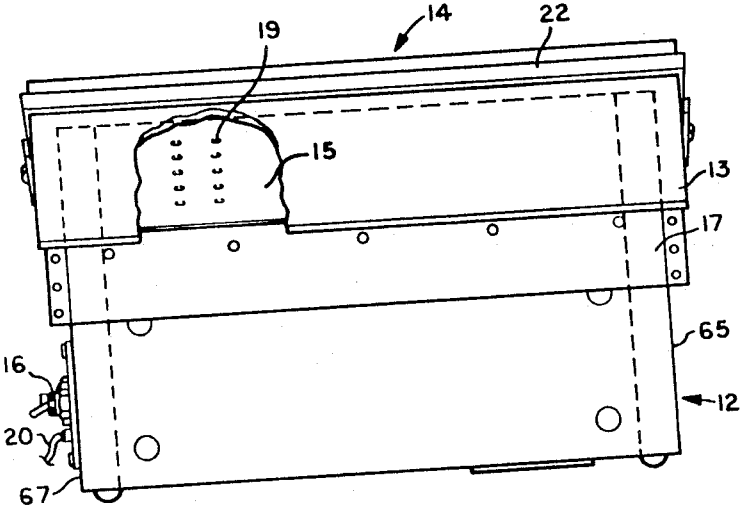
FIG. 2 is a rear elevational view of the device with portions broken away for illustration of the adjustability of the device.
Figure 5:
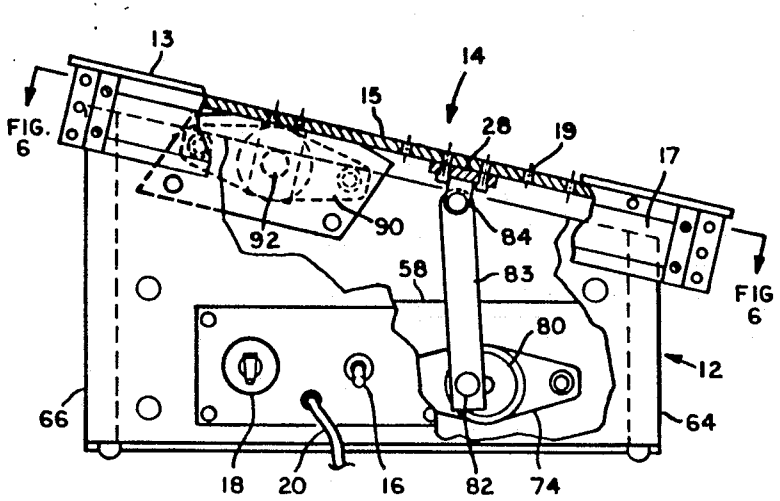
FIG. 5 is a side elevational view of the device with portions of the side wall cut away to illustrate the attachment of the connecting rod to both the platform and the eccentric disk so as to provide oscillatory motion to the platform and to independently support the platform above the vertical sides of the base.
Figure 4:
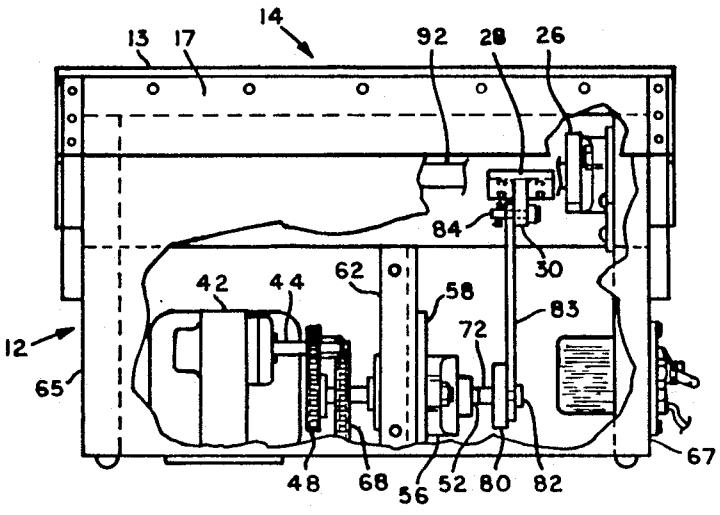
FIG. 4 is a front elevational view of the device with portions of the vertical front wall broken away to show portions of the drive means and the oscillating means.

The invention shown generally by numeral 10 was developed because of a need for a simple, efficient, and versatile exercise device. As shown in FIG. 1 the device consists of a base member 12, the lower portion of which rests upon a floor or suitable support, and a platform 14 pivotally attached to the upper portion of the base 12. A set of controls consisting of a switch 16 and a speed control 18 as well as an electrical power cord 20 are also illustrated in FIG. 1. As illustrated in FIG. 3 the platform 14 includes an electrically protective covering 13 of rubber, carpeting, etc., side portions 17, and a series of adjustment holes 19. Looking again at FIG. 1, a strap 22 is attached to the platform for retaining the feet or other extremity of the user if such is necessary. The strap 22 is also used to pass over barefeet or through a shoe or pair of shoes, much like ski shoes, which is utilized if the user is incapable of maintaining the proper foot position. The use, length, and location of the strap may be varied as desired. This strap is designed to be nonconstrictive and will not bind or impede blood flow. It simply holds toes down to make them point down.

Figure 7:
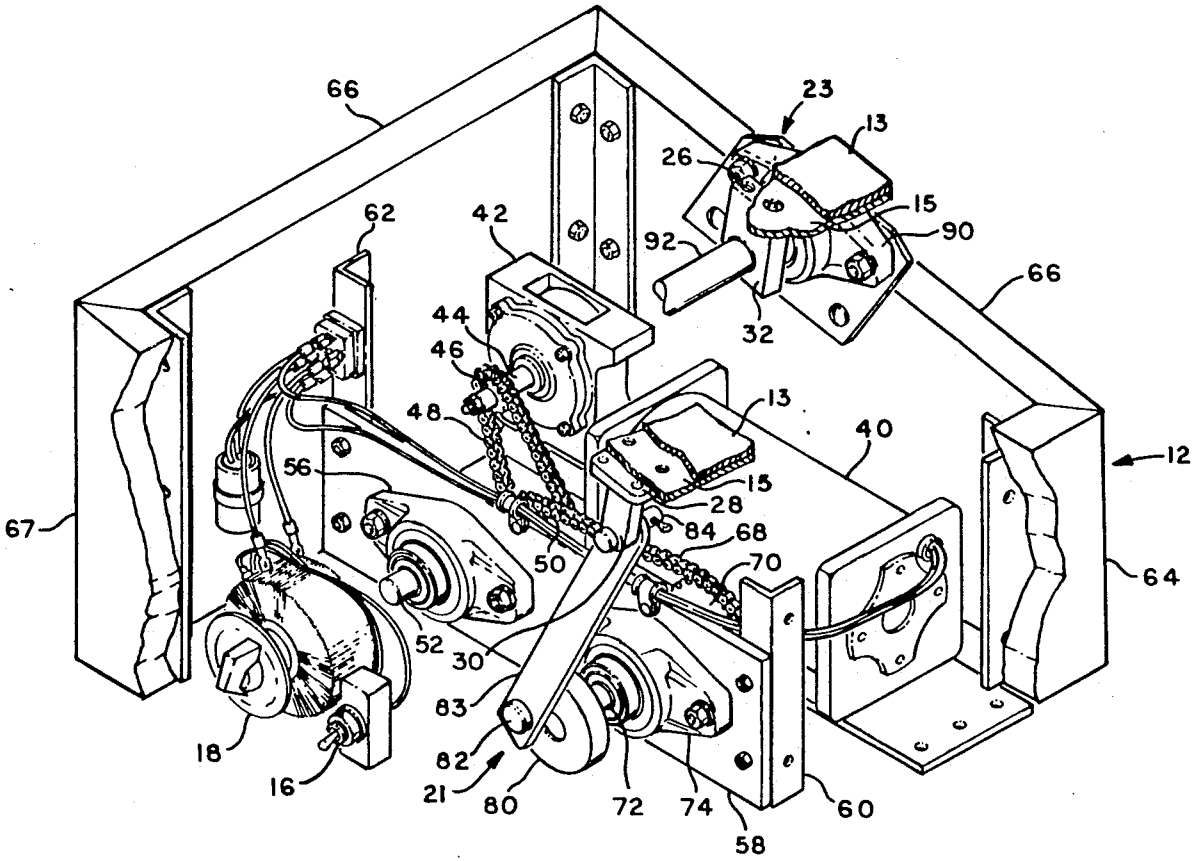
FIG. 7 is a perspective view of the device with major portions thereof broken away so as to illustrate the working of the inner portions which drive and control the device.

The inner workings of the device are best illustrated in FIG. 7 which illustrates assemblies 21 and 23 for imparting oscillatory and pivotal movements, respectively, to platform 14. FIG. 7 also illustrates the manner in which platform 14 is secured to the actuating apparatus. This is accomplished by providing oscillatory motion-imparting assembly 21 with an attachment block 30 and the pivotal motion-imparting assembly 23 with an attachment block 32 and securing platform 14 to the upper surfaces 28 and 26, respectively, of blocks 30 and 32.

Figure 6:
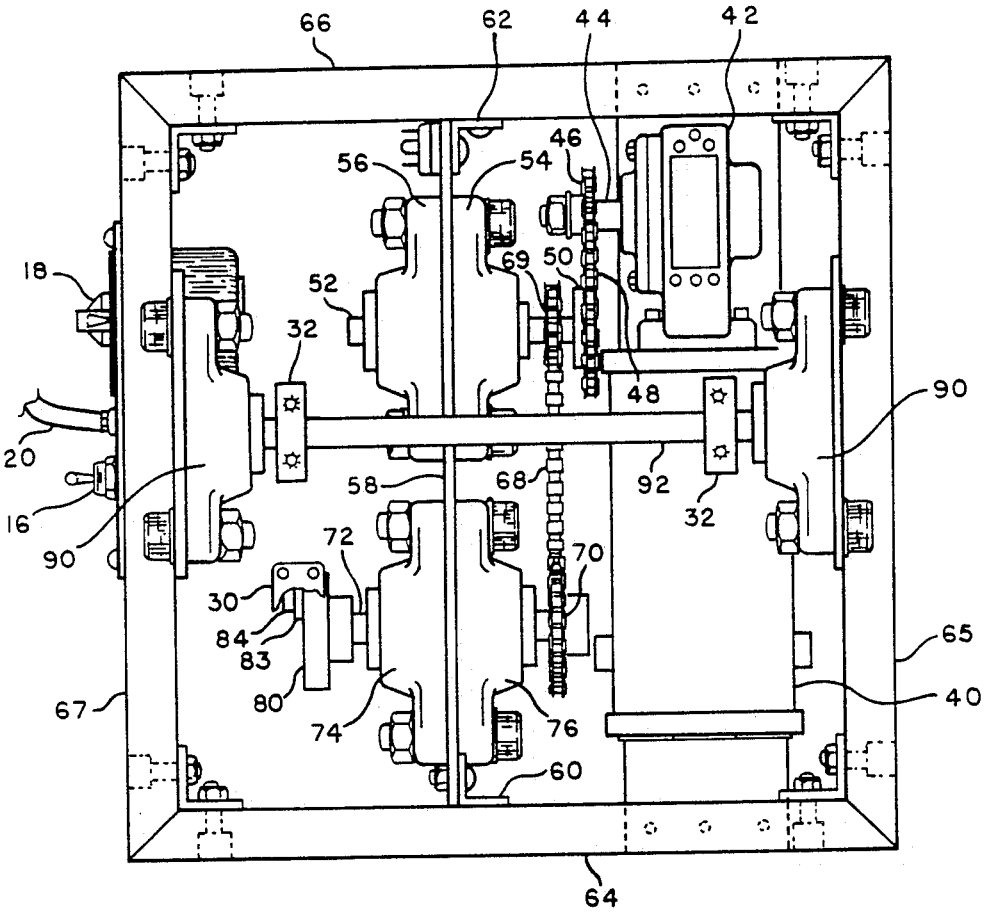
FIG. 6 is a top elevational view of the device taken along the line FIG. 6-FIG. 6 shown in both FIG. 3 and FIG. 5 and illustrating the inner components of the device.

To impart oscillatory motion to platform 14, the platform is actuated by an electric motor 40 which is attached to a worm gear reduction unit 42 having an output shaft 44 and a sprocket 46 attached thereto. A driving chain 48 provides driving connection to a sprocket 50 which is attached to an idler shaft 52. As illustrated in FIG. 6, the idler shaft 52 is supported by bearing blocks 54, 56 mounted on either side of a support bracket 58 which in turn is attached by means of angle braces 60, 62 to the rear and front walls 64, 66 of the base 12. The power transmitted to idler shaft 52 is then carried forward by means of a sprocket 69 attached to the idler shaft 52 and a chain 68 which engages a sprocket 70. The sprocket 70 is attached to the final drive shaft 72 which is supported by bearing blocks 74, 76 which are bolted to support bracket 58 in the same manner as the bearing blocks 54, 56. Attached to the final drive shaft 72 is an eccentric disk 80 having an outer journal 82 (see FIG. 7) which is pivotally attached to a rigid connecting rod 83. The connecting rod 83 is pivotally attached to a pin 84 which is fastened to attachment block 30. Thus the reduction chain drive and eccentric disk of this system serve to reduce the input speed from the motor and to convert the motor's rotating motion to an oscillating motion imparted to the attachment block 30. Pivotal movement is imparted to platform 14 as a result of the oscillating motion of blocks 30 raising and lowering the rearward portion of the platform. As more clearly seen in FIG. 6, a pair of bearing blocks 90 is secured to side walls 65 and 67 and supports a shaft 92 therebetween. Attachment blocks 32 are secured to shaft 92 adjacent opposite ends thereof and to the underside of platform 14. Blocks 32 are rigidly secured to shaft 92 for rotational movement therewith as the shaft pivots in bearing blocks 90 responsive to the oscillatory movement of platform 14.

OPERATION OF THE INVENTION

In operation the user of this exercise device would place the extremitY to be exercised, for example the feet, upon the upper surface of platform 14. The forward portion of the foot may be placed under strap 22 if desired. The device is started by actuation of switch 16, and its speed may be controlled by adjustment of rheostat 18. If the user wishes a pivotal motion only, the foot would be centered as desired over the pivot point of the platform, which is defined by shaft 92 mounted in bearing blocks 90. If both oscillating and pivotal motion is desired, the feet are moved toward the rear portion of the platform. The oscillating motion is increased as the feet are moved toward the rear of the platform, while movement of the feet from the pivot point toward the front or upper portion of the platform will result in an increase in oscillation of the forward portion of the feet and a decrease in oscillation of the heel portion. A greater or lesser oscillation movement of the platform itself may be achieved by forward or rearward adjustment of the position of attachment block 30 as described above and illustrated in FIG. 3.

As disclosed in detail above, the present invention provides a modern, passive exercise machine designed to exercise the limbs, particularly the feet, ankles and the leg muscles. The machine provides both pivotal and oscillatory motion which is gentle, smooth and rhythmic, without jerking motion or abrupt changes of direction. The machine eliminates springs and is designed to operate virtually maintenance free for long periods of time. The machine is completely enclosed and therefore completely safe for mentally ill, retarded or senile patients. The invention has a platform which is suspended above the tops and sides of the stationary base and which is freely capable of both pivotal and oscillatory movement without touching the tops or vertical sides of the base, yet it cooperates with the base to completely enclose the machine.

The unique features of this device which permit variation of the oscillation and pivoting relationship by positioning of the extremity at different locations on the platform, and, if necessary, by adjustment of the device, provide the broad spectrum of use needed to effectively accomplish the results described earlier in this specification.

While I have shown my invention in but one form it will be obvious to those skilled in the art that it is not so limited but is susceptible to various other changes and modifications without departing from the spirit thereof.

I claim:

1. An enclosed exerciser comprising:

a base comprising:

.a horizontal bottom portion; and an upper portion comprising an upstanding front wall, an upstanding rear wall which is lower in height than said front wall and two upstanding side walls, each said side wall being attached to one edge of said front wall and one edge of said rear wall, each said side wall having a top edge which slopes downward from the top edge of said front wall to the top edge of said rear wall:

a rectangular platform for supporting a user's feet, said platform being pivotally supported above said base and tilted downwardly from a point above said front wall of said base to a point above said rear wall of said base, said platform comprising:

a flat, rectangular top portion comprising both an outer surface and an inner surface; and four walls attached to said top portion and extending downward from the four edges of said top portion, said four walls of said platform overlapping and covering the top edges of said four upstanding walls of said upper portion of said base, said four walls of said platform being spaced apart from said four upstanding walls of said base, said platform being capable of moving independently of said base without touching any portion of said base;

pivotal means for supporting said platform above said base, said pivotal means being attached to the center portion of said inner surface of said top portion of said platform;

oscillating means for supporting said platform above said base, said oscillating means being attached to the lower portion of said inner surface of said top portion of said platform, said oscillating means being capable of exerting both a pushing and a pulling motion on said top portion of said platform;

electro-mechanical drive means attached to said oscillating means for imparting an oscillating movement to one portion of said platform and a pivotal movement to another portion of said platform; and means for varying the distance between said pivotal means and said oscillating means, whereby the extent of oscillation of said platform may be increased or decreased by varying said distance between said pivotal means and said oscillating means;

whereby said platform and said base together provide a complete enclosure for said exerciser and whereby selective placement of the user's feet on the forward or rear portion of said platform will result in a selective increase or decrease of both the oscillatory and pivotal motion imparted by the platform.

2. An exerciser as set forth in claim 1 comprising strap means for retaining extremities of the user, said strap means being attached to two of said four side walls of said platform.

3. An exerciser comprising:

an enclosure comprising:

a base comprising:

a horizontal bottom portion; and an upper portion comprising two upstanding side walls, an upstanding front wall and an upstanding rear wall, said rear wall being lower in height than said front wall, each said side wall being attached to one edge of said front wall and one edge of said rear wall; each said side wall having a top edge which slopes downward from the top edge of said front wall to the top edge of said rear wall;

a rectangular platform comprising:

a flat, top portion having both inner and outer surfaces, said outer surface of said top portion disposed for support of a person's foot or feet thereon; and four side walls which extend downward from the four edges of said top portion, said four side walls of said platform overlapping and covering the top edges of said four upstanding walls of said upper portion of said base, said side walls of said platform being spaced apart from said walls of said base; said platform being tilted downwardly from a point above the front wall of said base to a point above the rear wall of said base; said platform being capable of moving independently of said base without touching any portion of the structure of said base;

electro-mechanical drive means mounted in said enclosure;

oscillatory means connected to said drive means for supporting said platform above said base and imparting both pushing and pulling oscillatory movement to said platform, said oscillatory means comprising:

an eccentric disk connected to said driving means; and a rigid connecting rod having upper and lower ends, said lower end of said connecting rod being connected to said eccentric disk and said upper end of said connecting rod being connected to said inner surface of said platform; and pivotal means for pivoting and supporting said platform above said base, said pivotal means being attached to said enclosure and also pivotally attached to said inner surface of said platform, said pivotal means being arranged to impart pivotal movement to said platform about said pivotal means responsive to said oscillatory movement of said platform.

4. An exerciser as set forth in claim 3 wherein means are provided for varying the location of the attachment of said connecting rod to the inner surface of said platform whereby the extent of oscillation of said platform may be increased or decreased.

5. An exerciser as set forth in claim 4 wherein strap retaining means are provided on the upper surface of said platform for securely holding a person's limb in place on the said upper surface of said platform, said strap means being attached to two of said four side walls of said platform.

6. The exerciser as set forth in claim 5 wherein said platform contains a series of adjustment holes for selectively moving the point on said platform where said upper end of said connecting rod is connected to said inner surface of said platform.

7. The exerciser as set forth in claim 3 wherein said oscillatory means comprises an attachment block securely attached to said inner surface of said platform and wherein the said upper end of said connecting rod is pivotally connected to said attachment block.

8. The exerciser as set forth in claim 7 wherein said drive means for said oscillatory means comprises:

a motor;

a rheostat attached to said motor, for controlling the speed of said motor;

gear reduction means attached to said motor;

a final drive shaft attached to said eccentric disk; and chain drive means connected to and driven by said gear reduction means and connected to and driving said final drive shaft, said chain drive means comprising:

an output shaft attached to and driven by said gear reduction means;

a first sprocket wheel attached to said output shaft;

a plurality of bearing blocks attached to said horizontal bottom portion of said base;

an idler shaft supported in said bearing blocks;

second and third sprocket wheels mounted on said idler shaft, said second and third sprocket wheels being parallel to each other;

a first driving chain, driven by said first sprocket wheel and driving said second sprocket wheel;

a fourth sprocket wheel mounted on said final drive shaft; and a second driving chain, driven by said third sprocket wheel and driving said fourth sprocket wheel.

9. The exerciser set forth in claim 3 wherein said pivotal means comprises:

two bearing blocks, each one of said bearing blocks being attached to one of said two upstanding side walls;

a shaft extending between said two bearing blocks, the ends of said shaft being pivotally supported in said bearing blocks; and two pivotal attachment blocks, each of said pivotal attachment blocks being securely attached to said shaft near to one of said ends of said shaft adjacent to one of said bearing blocks, said pivotal attachment blocks also being securely attached to said inner surface of said platform;

whereby said platform may pivot about said shaft as said shaft pivots in said bearing blocks responsive to the oscillatory movement of said platform.

* * * * *